US008915670B2

(12) United States Patent
Ustach et al.

(10) Patent No.: US 8,915,670 B2
(45) Date of Patent: Dec. 23, 2014

(54) BOLLARD

(71) Applicant: McCue Corporation, Peabody, MA (US)

(72) Inventors: Thomas Ustach, Peabody, MA (US); Teodoro A. Mesa, Lynn, MA (US); Thomas Montgomery, Peabody, MA (US); David S. McCue, Manchester, MA (US); Timothy David Stratford, Buckinghamshire (GB)

(73) Assignee: McCue Corporation, Peabody, MA (US)

( * ) Notice: Subject to any disclaimer, the term of this patent is extended or adjusted under 35 U.S.C. 154(b) by 0 days.

(21) Appl. No.: 14/091,777

(22) Filed: Nov. 27, 2013

(65) Prior Publication Data

US 2014/0154007 A1 Jun. 5, 2014

Related U.S. Application Data

(63) Continuation-in-part of application No. 14/078,600, filed on Nov. 13, 2013.

(30) Foreign Application Priority Data

Nov. 15, 2012 (GB) ..... 1220541.5

(51) Int. Cl.
*E01F 9/00* (2006.01)
*E01F 15/00* (2006.01)
*E01F 9/019* (2006.01)

(52) U.S. Cl.
CPC ..... *E01F 15/003* (2013.01); *E01F 15/00* (2013.01); *E01F 9/019* (2013.01)
USPC ..... 404/9; 404/10

(58) Field of Classification Search
CPC ..... E01F 13/12; E01F 13/026; E01F 13/00; E01F 15/00; E01F 15/0461; E01F 9/175; E01F 9/011; E01F 9/017
USPC ..... 404/6, 9, 10; 40/608
See application file for complete search history.

(56) References Cited

U.S. PATENT DOCUMENTS

| | | | | |
|---|---|---|---|---|
| 3,674,304 | A * | 7/1972 | Swanson | 296/43 |
| 4,137,662 | A * | 2/1979 | Baumer | 40/612 |
| 4,564,309 | A * | 1/1986 | Bjorlund | 404/10 |
| 4,636,108 | A * | 1/1987 | Duckett | 404/10 |
| 4,858,876 | A * | 8/1989 | Moreno | 248/545 |
| 5,004,366 | A * | 4/1991 | Simmons | 403/2 |
| 5,483,917 | A * | 1/1996 | Walker | 116/63 P |
| 5,503,496 | A * | 4/1996 | Voigt | 404/10 |
| 5,848,502 | A * | 12/1998 | Schaefer | 52/165 |
| 7,901,156 | B2 * | 3/2011 | McCue et al. | 404/9 |
| 2005/0047861 | A1 * | 3/2005 | Climente | 404/6 |
| 2007/0110515 | A1 * | 5/2007 | Appelman | 404/6 |

* cited by examiner

*Primary Examiner* — Abigail A Risic
(74) *Attorney, Agent, or Firm* — Occhiuti & Rohlicek LLP

(57) ABSTRACT

An impact absorption apparatus includes a force transfer member including a base and a sidewall extending from the base, the base including an opening, a shock absorber disposed within the force transfer member and resting on the base, the shock absorber including a through hole, a plate disposed within the force transfer member and resting on the shock absorber, the plate including a through hole, and a fastener that extends through the base opening, the shock absorber through hole, and the plate through hole, the fastener including an end protruding from the base opening, the fastener end configured to secure the force transfer member to a support surface. The force transfer member is configured so that when an impact force is applied to the force transfer member, the force is transferred from force transfer member to the shock absorber.

15 Claims, 9 Drawing Sheets

BOLLARD

CROSS-REFERENCE TO RELATED APPLICATIONS

This application is a continuation-in-part of U.S. application Ser. No. 14/078,600, filed on Nov. 13, 2013 which claims the benefit of the priority date of U.K. Application No. 1220541.5, filed on Nov. 15, 2012.

This application is related to U.S. Pat. No. 8,444,343 which is incorporated herein by reference.

BACKGROUND

This invention relates to a bollard and to a method of fixing the bollard to the ground.

In supermarkets and retail stores, objects such as freezers refrigerators, shelving and product displays are susceptible to damage due to collisions with items such as shopping trolleys, floor scrubbers and pallet jacks. For example, freezer and refrigerator cases typically include a glass or transparent plastic door for viewing the products inside without opening the door. The glass can be shattered or the plastic scratched, upon impact with shopping trolleys. Since the body of many of these floor fixtures is constructed of lightweight metals or hardened plastic it can be easily dented or cracked by such impacts. Likewise, in industrial locations such as warehouses and manufacturing facilities, both internally and externally, product storage, doorways and equipment are susceptible to damage due to collisions with heavy equipment, such as delivery vehicles and forklifts.

A bollard protects objects and fixtures from collisions with all types of vehicles. Bollards are commonly employed inside a store to protect store fixtures and outside a store to protect outdoor structures from collisions, to indicate parking areas, to block vehicle and heavy equipment access to a particular area, and to direct flow of traffic. Bollards can also be used to block vehicular access for security reasons.

There are two primary types of bollards; plate-mounted bollards and core-drilled bollards. Plate-mounted bollards conventionally involve a steel plate having three or four bolt holes and a bollard extending perpendicularly from one face of the plate. The plate sits on the floor and bolts are used to fasten the plate, and therefore the bollard, to the floor through the bolt holes. There is no significant disruption to the ground or floor, other than the bolt holes, which are in some instances pre-drilled. On the other hand, core-drilled bollards conventionally require a major disruption to the ground or floor with the creation of a hole two to four feet deep and having a larger diameter than the bollard itself, for example eight inches to two feet, or larger. Concrete is poured into the hole and the bollard is placed in the concrete and held vertically while the concrete cures. In some instances, concrete is also poured into the hollow bollard itself. Installation of a core-drilled bollard is significantly more expensive than with a plate-mounted bollard, and takes significantly more time to complete. However, there are locations where the core-drilled bollard is required due to its ability to absorb larger impacts than the plate-mounted bollard.

Plate-mounted bollards are conventionally utilised in areas where impacts are more likely to be less severe, and involve lighter objects, or where no significant impacts are likely and the bollard serves more as a marker. For example, inside a grocery store in front of a freezer case any impact would likely be from a shopping trolley or floor polisher. Such an impact would be considered to be low-energy, or relatively minor. Accordingly, a plate-mounted bollard would be appropriate for this type of installation. However, in a warehouse with heavy equipment, such as delivery vehicles and forklifts, impacts are more likely to be more severe, or high-energy. A vehicle backing up may accidentally collide with a bollard. Accordingly, a core-drilled bollard would be more appropriate in these types of settings.

SUMMARY

There are a substantial number of installations where a conventional plate-mounted bollard does not provide quite enough impact protection; however, a core-drilled bollard is significantly over-sized for the application. Yet, a core-drilled bollard is installed because the conventional plate-mounted bollard falls short of providing the required protection. Likewise, there are installations where a core-drilled bollard is necessary to provide protection against likely impacts, yet a plate-mounted bollard is installed because they are less expensive or there are logistical problems with drilling four foot deep holes for the core-drilled bollard installation. Other factors may influence the selection of a plate-mounted bollard or a core-drilled bollard.

To address this issue, a bollard having an impact absorption mechanism is disclosed in U.S. Pat. No. 7,901,156 B2. This patent discloses a plate-mounted bollard which includes an internal impact absorption mechanism that enables the bollard to absorb impact forces greater than conventional plate-mounted bollards. The bollard makes use of a force transfer process that shifts impact forces to areas better able to resiliently absorb the impact without causing damage to the bollard, the impact absorption mechanism, or the ground in which the bollard is installed. The impact absorption mechanism consists of an internal resilient core rod mounted at its proximal end to a base plate which is fixed to the ground. Impact forces are then transferred through an outer shell to the distal or upper end of the internal resilient core. With energy from the impact force being distributed along the maximum length of the resilient core rod, the rod flexes and the full length of the rod is utilized to absorb the impact energy.

Although the bollard of this patent is an effective solution to the provision of a plate-mounted bollard in situation where a core-drilled bollard would normally have been preferred, this bollard is relatively complex and expensive to manufacture and maintain and is not an ideal solution in all circumstances.

It is therefore an object of the invention to improve upon the known art.

According to a first aspect of the present invention, there is provided a bollard comprising an elongate outer tubular cover, an elongate inner tubular core located within the outer tubular cover, a damper located at a lower end of the inner tubular core, and a washer arranged to locate the damper against the inner tubular core, wherein the outer tubular cover and the inner tubular core are both substantially circular in horizontal cross-section and the outer tubular cover is able to rotate relative to the inner tubular core.

According to a second aspect of the present invention, there is provided a method of fixing a bollard to the ground comprising receiving an elongate outer tubular cover, an elongate inner tubular core, a damper, a washer and one or more bolts, passing the or each bolt through the washer, damper and inner tubular core and into the ground, and placing the outer tubular cover over the inner tubular core such that the outer tubular cover is able to rotate relative to the inner tubular core.

Owing to the invention, it is possible to provide a bollard that can be used as a plate-mounted bollard that will provide effective collision protection and will also disperse the energy from a low level collision, without any damage to the bollard. The outer cover and the inner core transfer collision energy to the damper within the bollard, which absorbs and disperses the energy of a collision. The bollard is relatively simple to manufacture and install and comprises a small number of relatively straightforward components. The outer tubular cover and the inner tubular core are both substantially circular in horizontal cross-section and the outer tubular cover and the inner tubular core are preferably not connected together. This form of construction of the bollard allows the outer cover to rotate relative to the inner core and this further helps to disperse the energy from a collision, as the rotation of the outer cover will absorb energy prior to any further energy being transmitted to other components within the bollard.

In a general aspect, an impact absorption apparatus includes a force transfer member including a base and a sidewall extending from the base, the base including an opening, a shock absorber disposed within the force transfer member and resting on the base, the shock absorber including a through hole, a plate disposed within the force transfer member and resting on the shock absorber, the plate including a through hole, and a fastener that extends through the base opening, the shock absorber through hole, and the plate through hole, the fastener including an end protruding from the base opening, the fastener end configured to secure the force transfer member to a support surface. The force transfer member is configured so that when an impact force is applied to the force transfer member, the force is transferred from force transfer member to the shock absorber.

Aspects may include one or more of the following features.

A diameter of the opening of the base may be greater than a diameter of the fastener. The force transfer member may be a bumper and the sidewall of the bumper may include an impact deflection portion and one or more flanges extending from the impact deflection portion. The impact deflection portion may have a substantially semi-circular shape. The base may have a substantially semi-circular shape. The shock absorber may have a substantially semi-circular shape.

The plate may have a substantially semi-circular shape. Each of the one or more flanges may include a notch causing at least a portion of the flange to be elevated above the support surface. The notch may have a rectangular shape. The notch may have a triangular shape. Each of the one or more flanges may have a substantially triangular shape. The impact absorption apparatus may be configured to evenly distribute a force of impact from the force transfer member into the shock absorber.

The shock absorber may include an elastomeric material. The elastomeric material may be a rubber material. The fastener may be a bolt.

The sidewall may have an elongate tubular shape with a first cross-sectional diameter. The impact absorption apparatus may include a cover having an elongate tubular shape with a second cross-sectional diameter greater than the first cross-sectional diameter. The sidewall may be disposed within the cover and the cover is able to rotate relative to the sidewall.

Advantageously, the outer tubular cover and the inner tubular core are both ground-contacting, with the inner tubular core being closed at the lower end, wherein the washer directly contacts the damper and the damper directly contacts the closed lower end of the inner tubular core. This provides the most effective arrangement of the components, with the outer cover and the inner core both grounded. The inner core is closed at the ground-contacting end with a flat plate which has the washer clamping the damper against the flat plate of the inner core.

Ideally, the inner tubular core comprises one or more spacing elements on the external surface thereof. In the preferred embodiment, each spacing element comprises a substantially horizontal ring around the inner tubular core and the inner tubular core comprises two spacing elements on the external surface thereof. The spacing elements provide two main functions, firstly in that they support the rotation of the outer cover around the inner core, during any collision, and secondly they can provide their own shock-absorbing function during a collision. The outer tubular cover can comprise one or more holes, each hole locating a fixing lug. At least one hole is located below a spacing element and the respective fixing lug extends inside the outer tubular cover in a position below the spacing element. The provision of the holes and lugs relative to the spacing elements provides a simple way of retaining the outer cover in position relative to the inner core, without there being any direct connection between these two components.

Among other advantages, embodiments more evenly distribute forces of impact into the shock absorber than conventional impact absorbing bollards or rack guards.

The bollards and rack guards can receive repeated impacts without needing to be replaced. This is advantageous when compared to conventional bollards and rack guards which can be destroyed by a single impact.

DESCRIPTION OF DRAWINGS

Embodiments of the present invention will now be described, by way of example only, with reference to the accompanying drawings, in which.

DESCRIPTION

Figure 1:
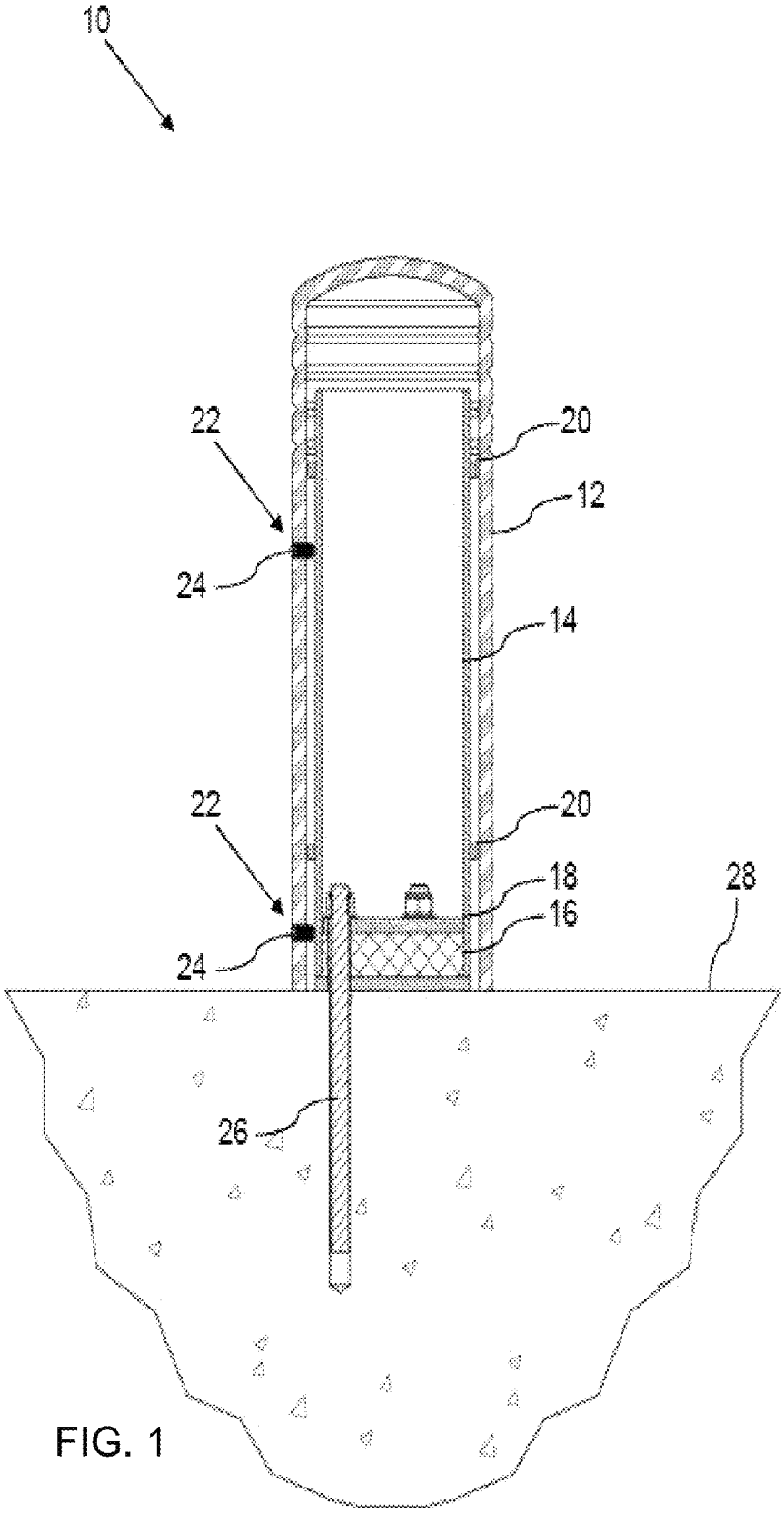
FIGS. 1 and 2 are views of a vertical section through a bollard in the ground.

FIG. 1 shows a bollard 10 in the ground 28. The Figure shows a vertical section through the bollard 10. The bollard 10 comprises an elongate outer tubular cover 12, an elongate inner tubular core 14 located within the outer tubular cover 12, a damper 16 located at a lower end of the inner tubular core 14, and a washer 18 arranged to locate the damper 16 against the inner tubular core 14. The outer tubular cover 12 and the inner tubular core 14 are both substantially circular in horizontal cross-section and the outer tubular cover 12 is able to rotate relative to the inner tubular core 14. The outer cover 12 and the inner core 14 are not connected together. The outer cover 12 and the inner core 14 are both ground-contacting.

The washer 18 directly contacts the damper 16. The inner core 14 is closed at the lower end and the damper 16 directly contacts the closed lower end of the inner core 14. The inner core 14 also comprises two spacing elements 20 on its external surface. Each spacing element 20 comprises a substantially horizontal ring around the inner core 14. The outer cover 12 has two holes 22, each hole 22 locating a fixing lug 24. Each hole 22 is located below a respective spacing element 20 and the respective fixing lug 24 extends inside the outer cover 12 towards the inner core 14 in a position below the respective spacing element 20.

The bollard further comprises three bolts 26, each bolt 26 passing through the washer 18, damper 16 and inner core 14 and into the ground 28. The bolts push together the washer 18, damper 16 and inner core 14 so that any collision energy is ultimately transferred to the damper 16 which disperses the energy from any collision. The bolts 26 anchor the bollard 10 to the ground 28 and keep the bollard 10 in position. Should any object strike the bollard 10 in a collision then the energy of that collision is directed to the damper 16 through the outer cover 12 and the inner core 14 and the energy is dispersed in this way.

Figure 2:
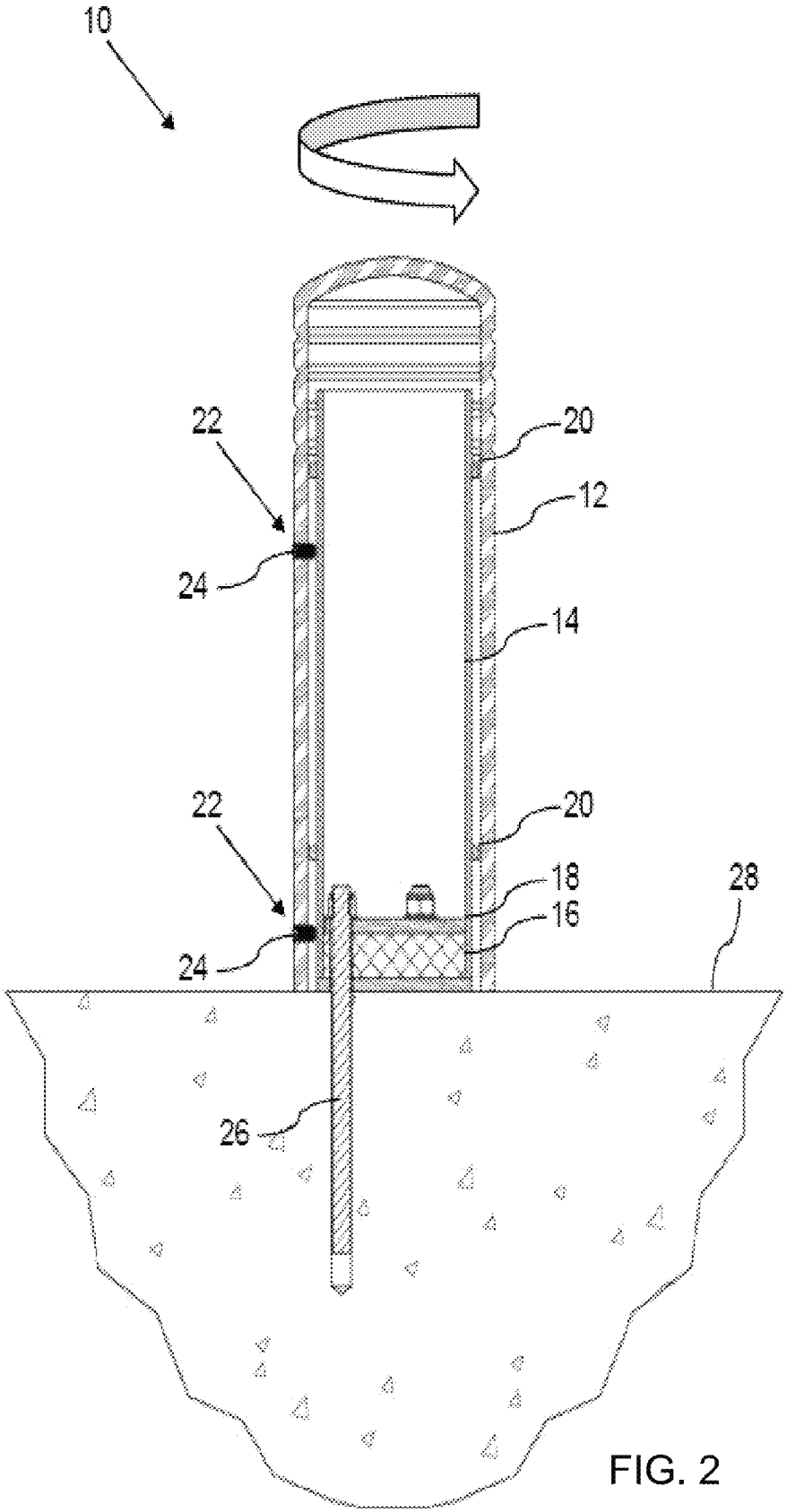

FIG. 2 shows a view similar to FIG. 1, with an arrow indicating the fact that the outer cover 12 can rotate relative to the inner core 14. Although the inner core 14 is fixed relative to the ground 28 by the bolts 26, the outer cover is not actually physically connected to the inner core 14 and is not restrained in any way. There is no connection between these two components of the bollard 10. This allows the outer cover 12 to rotate. This provides further collision damage protection, as the initial energy from any collision with the bollard 10 will be first dispersed as rotational energy, rotating the outer cover 12.

This collision protection is assisted by the spacing elements 20 that are fixed to the outside of the inner core 14. The bollard 10 is provided with two spacing elements 20 that are each formed as a ring around the inner core 14. The spacing elements 20 form part of the inner core 14 and are not fixed to the outer cover 12. The spacing elements 20 have a horizontal thickness that is slightly smaller than the gap between the outer cover 12 and the inner core 14. The spacing elements 20 are made from steel and are designed to reduce the surface contact between the outer cover 12 and the inner core 14, thus reducing the friction between the two parts thereby allowing the outer cover 12 to rotate.

The outer cover 12 is provided with two holes 22, vertically one above the other. These holes 22 receive lugs 24 that can be screwed into position. As can be seen in FIGS. 1 and 2, these lugs 24 are flush to the outer surface of the outer cover 12 but extend inwards from the outer cover 12 to touch the inner core 14. The lugs help to retain the outer cover 12 in position, while not restricting the rotation of the outer cover 12 during a collision. Each lug 24 is below a respective spacing element 20, and this prevents the removal of the outer cover 12, once the lugs 24 are in position. The position of a hole 22 (and therefore a lug 24) below a respective spacing element 20 also allows the outer cover 12 to move upwards in a collision, to further disperse energy from that collision. So, although the lugs 24 prevent the full removal of the outer cover 12, they do not stop the outer cover rising upwards during a collision.

Figure 3:
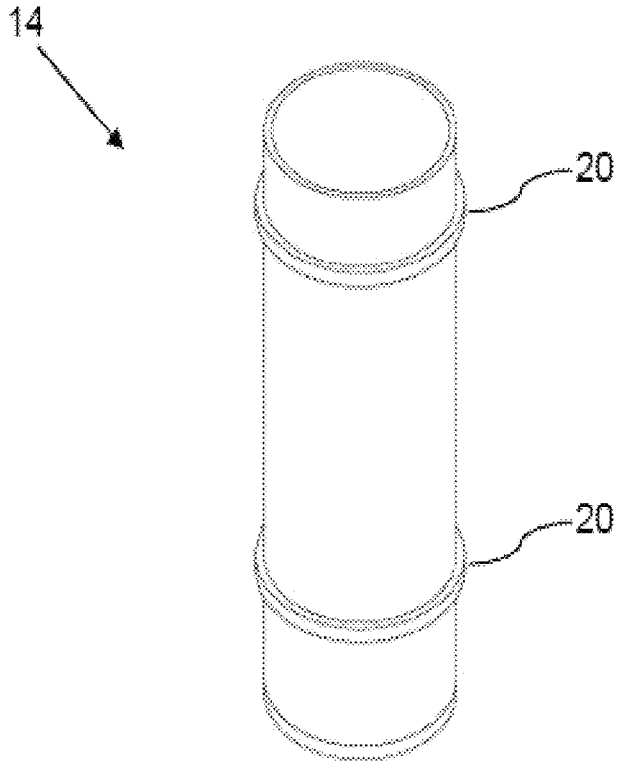
FIG. 3 is a perspective view of an inner core of the bollard.

FIG. 3 shows a perspective view of the inner core 14 of the bollard 10 in an upright position as it would be in use in the bollard 10. The two spacing elements 20 can be seen on the exterior of the inner core 14, one of which is towards the upper end of the inner core 14 and the other of which is towards the lower end of the inner core 14. These spacing elements 20 provide the dual purpose of creating spacing between the inner core 14 and the outer cover 12 when the bollard is in use and providing shock absorption in the event of a collision.

Figure 4:
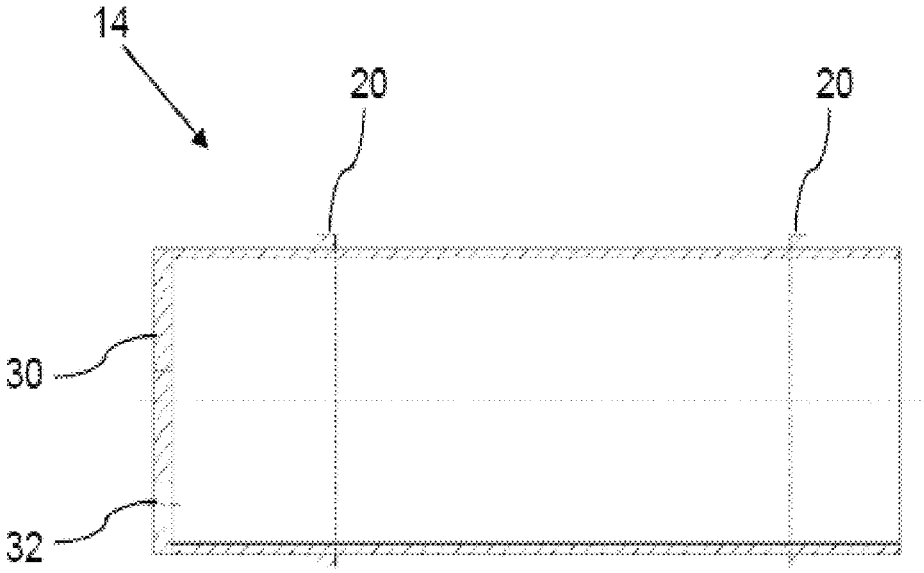
FIG. 4 is a vertical section through the inner core of FIG. 3.

A vertical section through the inner core 14 is shown in FIG. 4, which shows again the position of the spacing elements 20. At the lower end 30, the inner core 14 is closed, so that the essential form of the inner core 14 is a circular cross-section elongate tube that is closed at one end. The closed end 30 is provided with three holes 32 to receive the bolts 26, when the bollard 10 is constructed in position. The inner core 14 is manufactured from a steel tube with a circular steel plate 30 used to close the one end of the inner core 14. Holes are drilled into steel plate 30.

As discussed above, the inner core 14 of the bollard 10 is ground-contacting, with the lower end 30 lying horizontally on the ground 28, with the elongate tubular part of the inner core 14 extending upwards in a vertical direction, as shown in FIG. 3. The bolts 26 fasten the inner core 14 in place, passing through the washer 18 and damper 16 and then through the holes 32 in the base plate 30 that forms the lower end of the inner core 14. The bolts 26 are anchoring the inner core 15 tightly to the ground 28 and ensure that the inner core 14 is fixed in a rigid upright position.

Figure 5:
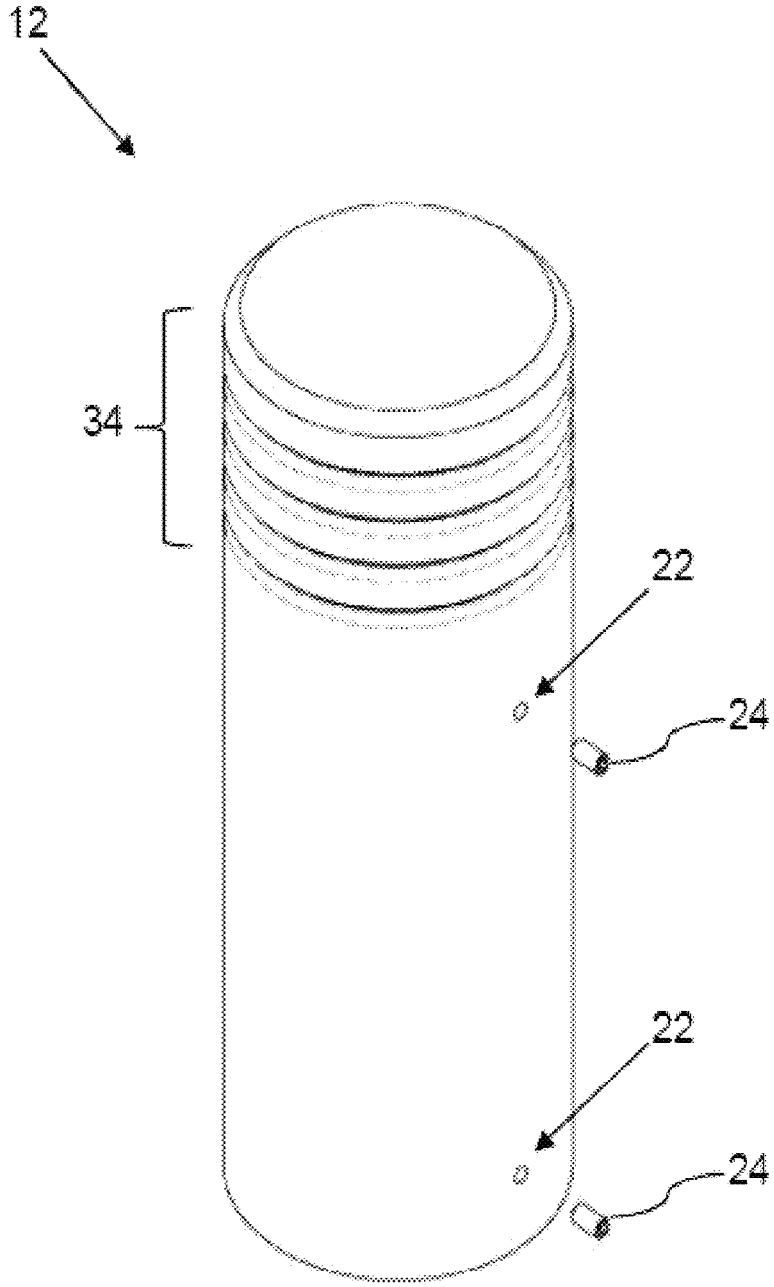
FIG. 5 is a perspective view of an outer cover of the bollard.

The outer cover 12 is shown in a perspective view from above in FIG. 5. The outer cover 12 forms the exterior of the bollard 10 and any collision with the bollard 10 will be directly onto the outer cover 12. As discussed above, the outer cover 12 sits directly on the ground 28 and is not actually connected to any other part of the bollard 10 or indeed to the ground 28. The outer cover 12 is free to rotate during a collision in order to dissipate as much as energy as possible, without causing damage to any of the components of the bollard 10 or to the ground 28.

As can be seen in this Figure, the outer cover 12 is provided with holes 22 that lie on the same vertical line. These holes 22 are located so that they are underneath respective spacing elements 20 on the exterior of the inner core 14, when the bollard 10 is assembled in position. The lugs 24 fit into the holes 22 and can be screwed in so that they are flush with the outer surface of the outer cover 12 and will be so positioned that they extend under the respective spacing element 20. This will prevent unauthorised removal of the outer cover 12 as the lugs 24 will retain the outer cover 12 under the spacing elements 20.

The essential form of the outer cover 12 is a circular cross-section elongate tube that is closed at one end. It is constructed of robust plastics material that will not dent or easily be deformed. The outer cover 12 is a moulding which can be coloured to ensure that is visually stands out as much as possible. At the upper end of the outer cover 12 is a grooved section 34.

Figure 6:
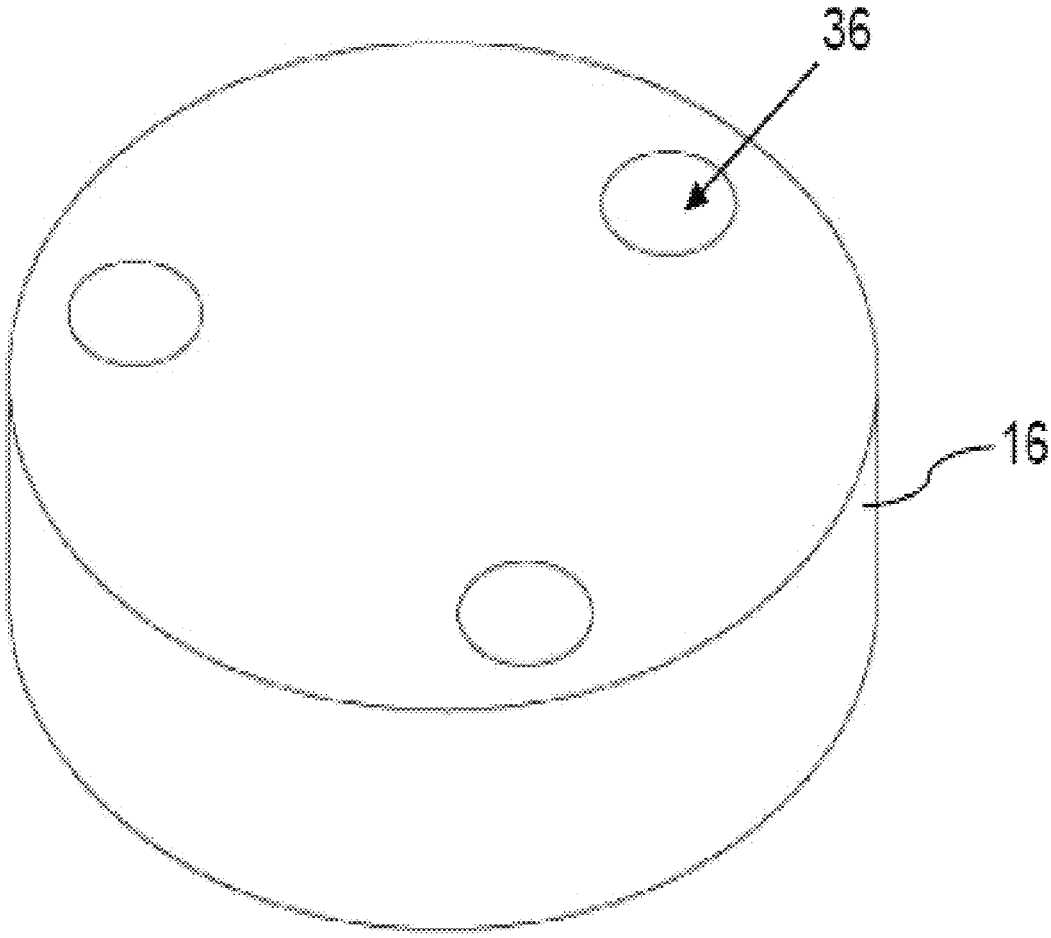
FIG. 6 is a perspective view of a damper of the bollard.

The damper 16 is shown in FIG. 6, which shows a perspective view of the damper 16. The damper 16 is provided with three holes 36 that receive the bolts 26 that are used to hold the damper 16 in position. The damper is made from rubber or some other suitable deformable plastics material that will absorb and disperse as much as possible of the energy of any collision with the bollard 10. The damper 16 is held tightly against the inner core 14 by the washer 18 and the collision energy travels from the outer cover 12 to the inner core 14 to the damper 16, which disperses the energy of the collision.

Figure 7:
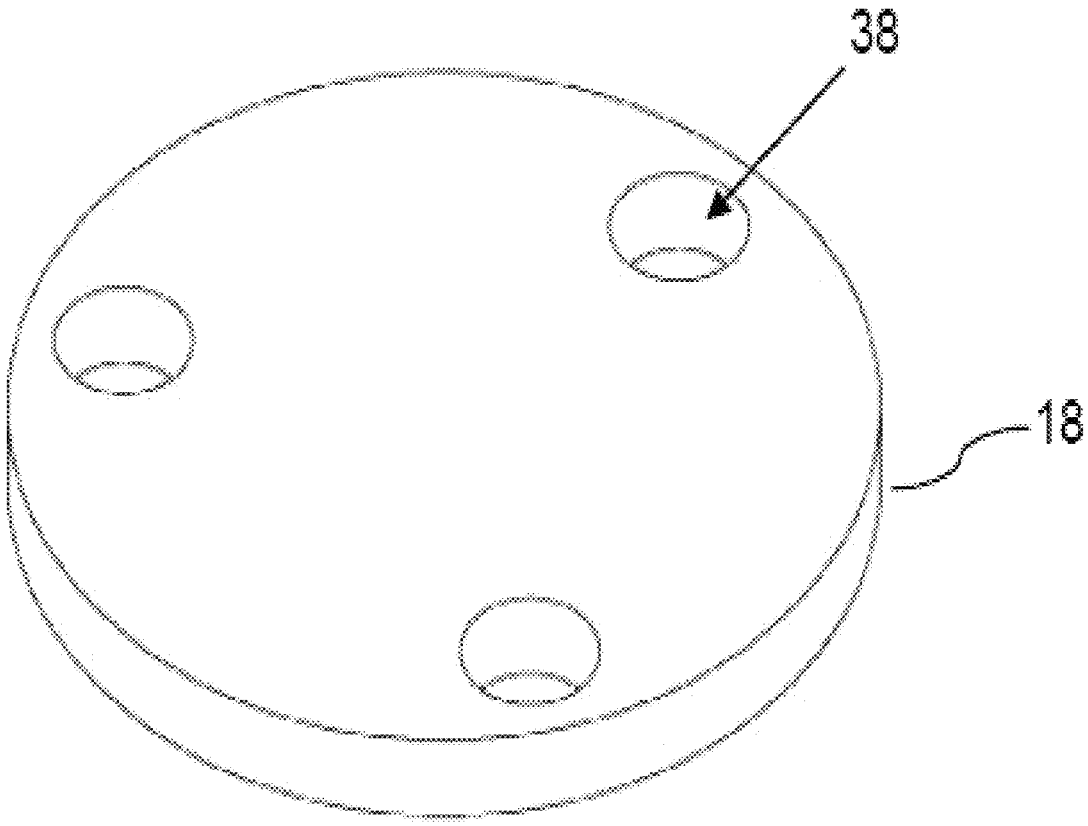
FIG. 7 is a perspective view of a washer of the bollard.

The washer 18 is shown in perspective view from above in FIG. 7. The steel washer 18 is provided with three holes 38 that receive the bolts 26 that are used to hold the washer 18 in position. The washer 18 presses down on the damper 16 as the bolts 26 are tightened to retain the inner core 14 against the ground 28. This ensures that the inner core 14, the damper 16 and the washer 18 are all tightly pressed together and held in position once the bollard 10 is assembled. This will mean that in the event of a collision, the energy of the collision will reach the damper 16, which disperses as much of the energy as possible.

The bollard 10 has a very simple construction and is very easy to assemble. The damper 16 and the washer 18 both have a circumference that matches the interior shape of the inner core 14 and are placed in the bottom of the inner core 14. The inner core 14 can be placed onto the ground 28 and retained in place using the bolts 26. The outer cover 12 is then placed over the inner core 14 and the lugs 24 are screwed into the holes 22 as far as possible in order to prevent the unauthorised removal of the outer cover 12. In this way, the bollard 10 is assembled in position.

Figure 8:
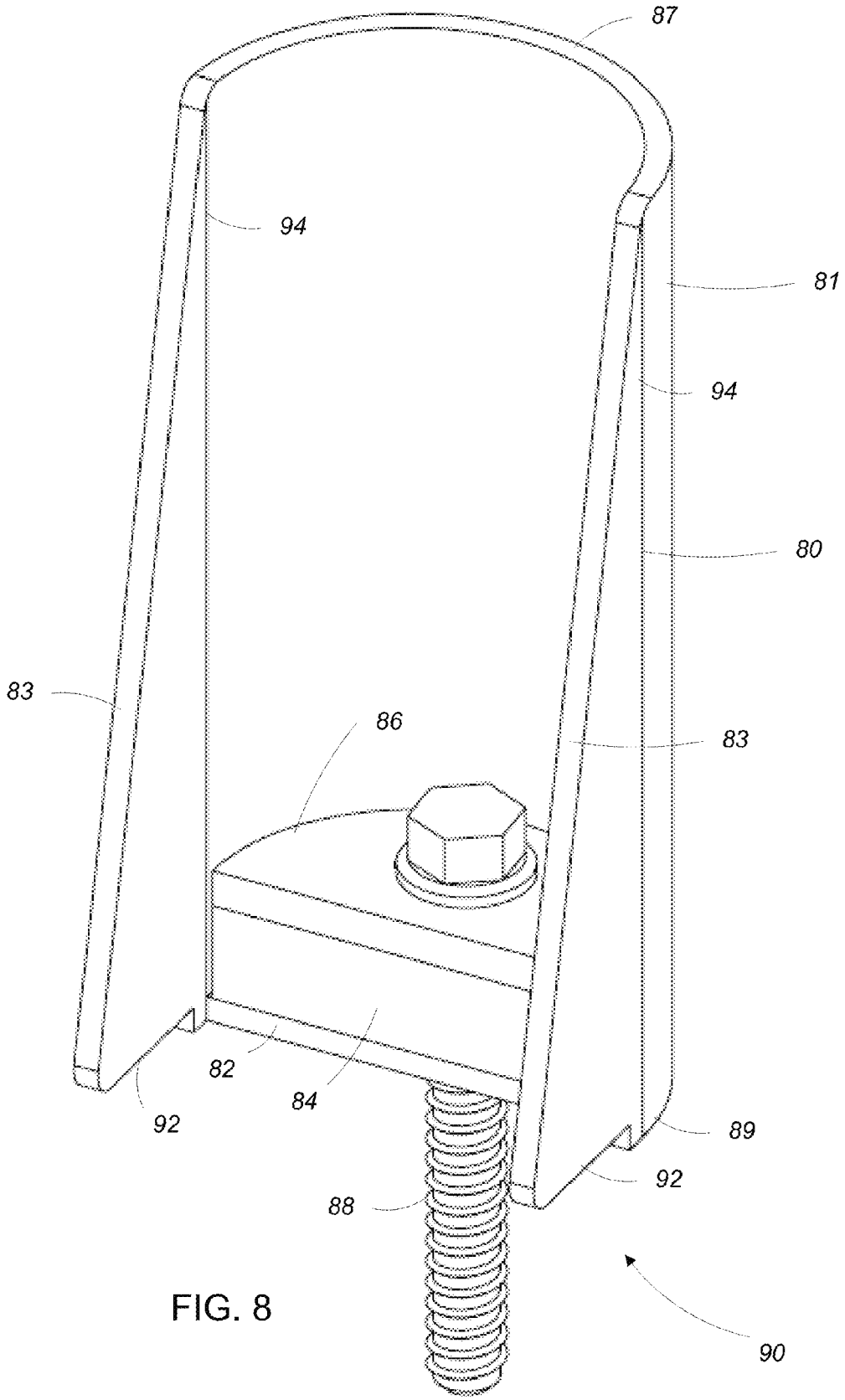
FIG. 8 is a rear perspective view of an impact absorption apparatus.

Referring to FIG. 8 in another embodiment, an impact absorption apparatus 90 utilizes a similar impact absorption mechanism as the inner core of the bollard described above but does not require an outer cover. The impact absorption apparatus 90 includes a bumper 80, a shock absorber 84 and a free top plate 86. The bumper 80, the shock absorber 84, and the free top plate 86 are held in an assembled position using a fastener such as a bolt 88.

Figure 9:
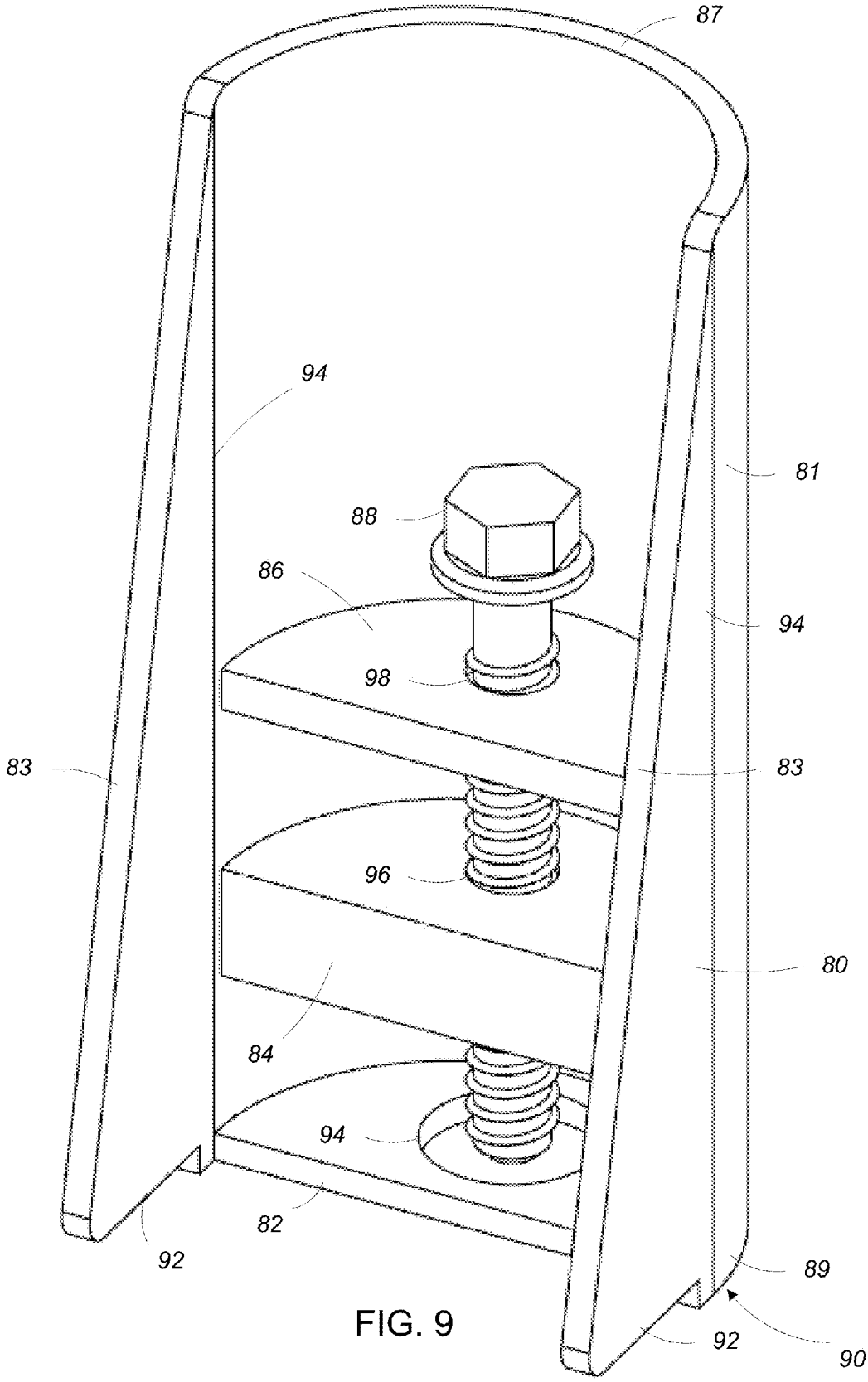
FIG. 9 is an exploded rear perspective view of the impact absorption apparatus.
Figure 10:
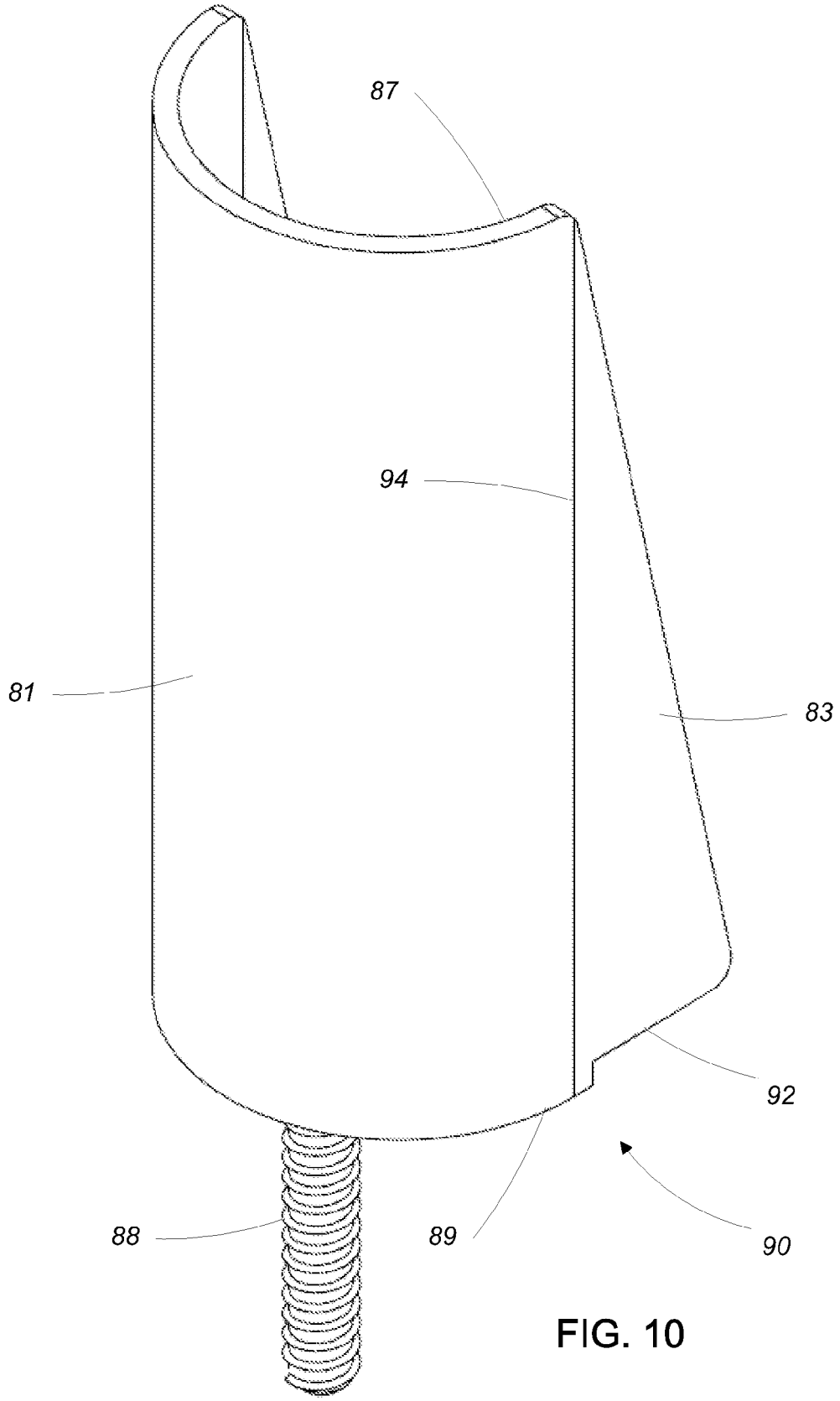
FIG. 10 is a front perspective view of the impact absorption apparatus.

Referring to FIG. 9, the impact absorption apparatus 90 of FIG. 8 is shown in an exploded state to better illustrate the individual elements mentioned in relation to FIG. 8. The bumper 80 includes a fixed bottom plate 82 (i.e., a base) and a sidewall including a rounded front portion 81 and two substantially triangular flanges 83 extending from the rounded front portion 81.

The rounded front portion 81 extends from a top end 87 of the bumper 80 to a bottom end 89 of the bumper 80. In some examples, the rounded front portion 81 has a hollow, semi-circular shape (e.g., the shape of a half of a pipe). In general, at least a portion of the rounded front portion 81 at the bottom end 89 of the bumper 80 rests on the ground (not shown).

The rounded front portion 81 has two ends 94 from which the two substantially triangular flanges 83 extend. The flanges 93 also extend from the top end 86 to the bottom end 90 of the bumper 80. In some examples, a width of each of the flanges 93 increases as the flanges 83 extend from the top end 87 toward the bottom end 89, resulting in the triangular shape of the flange 93. In general, at least a portion of each of the flanges 93 at the bottom end 89 of the bumper rests on the ground (not shown).

In some examples, each of the flanges 93 includes a notch 92 at the bottom end 89 of the bumper 80. The notch 92 causes at least a portion of the flange 93 to be elevated from the ground (not shown). In some examples, the notches 92 in the flanges 83 lessen the amount of force that is required to cause the bumper 80 to lean or pivot when it is struck by an object. In some examples, the length and depth of the notches 92 can be adjusted based on an expected force of impact for a given application. If an impact has enough force, the bumper 80 will eventually pivot to the extent that the flanges 83 contact the ground. In this case, the triangular shape of the flanges 93 along with the strength of their material causes the bumper 80 to stop transferring force into the shock absorber 84 and instead act as a hard-stop barrier The fixed bottom plate 82 has a shape which corresponds to an interior of the rounded front portion 81 (e.g., a semi-circle) such that it can be affixed into the rounded front portion 81 at its bottom end 89, substantially capping the bottom end 89 of the rounded front portion 81. The fixed bottom plate 82 includes a hole 94 through which the bolt 88 can be inserted. In general, the hole 94 has a diameter which is greater than a diameter of the bolt 88. The greater diameter provides clearance between the inner edge of the hole 94 and the bolt 88. The clearance allows the bumper 80 to move with two degrees of freedom about the bolt 88 and ensurEs that the bumper 80 can pivot to a certain extent before the bolt 88 makes contact with the inner edge of the hole 94. Without the larger diameter hole, the bolt 88 would be easily damaged upon impact.

The shock absorber 84 has a shape corresponding to the interior of the rounded front portion 81 (e.g., a semi-circle) such that it can be inserted into the rounded front portion 81, resting on the fixed bottom plate 82. In general, the shock absorber 84 is fabricated using an elastomeric material such as rubber. The shock absorber 84 includes a hole 96 through which the bolt 88 can be inserted. The hole 96 has a diameter corresponding to the diameter of the bolt 88.

The free top plate 86 has a shape corresponding to the interior of the rounded front portion 81 (e.g., a semi-circle) such that it can be inserted into the rounded front portion 81, resting on top of the shock absorber 84. The free top plate 86 includes a hole 98 through which the bolt 88 can be inserted. In general, the hole 98 has a diameter corresponding to the diameter of the bolt 88. The free top plate 86 is not directly attached to the bumper 80.

When the bumper 80 is assembled as is shown in FIG. 8, the shock absorber 84 is inserted into the front portion 81 of the bumper 80, resting on the fixed bottom plate 82. The free top plate 88 is then inserted into the front portion 81 of the bumper 80, resting on the shock absorber 84. The bolt 88 is then inserted through the respective holes in the free top plate 86, the shock absorber 84, and the fixed bottom plate 82 and into a support surface such as a receiving member anchored in the ground (not shown). The bolt 88 is tightened such that the shock absorber 84 is held snug in place between the free top plate 86 and the fixed bottom plate 82.

In operation, when an object impacts the bumper 80, the bumper 80 pivots about the bolt 88, leaning away from the impact until the flanges 83 make contact with the ground. As the bumper 80 leans, the fixed bottom plate 82 leans and presses against the shock absorber 84 which in turn presses against the free top plate 86. Since the free top plate 86 is held in place by the bolt 88, the shock absorber 84 compresses between the two plates 82, 86, absorbing the force of the impact.

In some examples, the pressure exerted on free top plate 86 by the shock absorber 84 causes the free top plate 86 to lean such that it is maintained in an orientation that is substantially parallel to the fixed bottom plate 82. By maintaining a substantially parallel orientation between the fixed bottom plate 82 and the free top plate 86, the force of the impact is more evenly distributed into the shock absorber 84 than would be the case if the two plates 82, 86 were angled relative to one another.

Once the force of impact on the bumper 80 relents, the resilient material used in the shock absorber 84 returns to its original shape, which in turn returns the bumper 80 to its original position.

Referring to FIG. 11, a front perspective view of the bollard illustrates the rounded bumper portion 81. In some examples, the rounded bumper portion 81 causes objects impacting the bumper 80 to glance off of the bumper 80, thereby reducing the amount of force transferred from the bumper 80 into the shock absorber 84 by the impact.

In some examples, the bumper is fabricated using a metallic material such as steel. In such cases the fixed bottom plate is welded into the interior of the front portion of the bumper. In other examples, the bumper is fabricated using a plastic material such as polyvinyl chloride. In such cases, the fixed bottom plate is either attached to the interior of the front portion of the bumper using a high strength epoxy or integrally formed with the front portion of the bumper.

In some examples, the notches in the flanges are rectangular in shape. In other examples, the notches are triangular in shape.

What is claimed is:

1. An impact absorption apparatus comprising:

a force transfer member including:

a base having an opening; and a bumper including a sidewall extending from the base, the sidewall of the bumper including an impact deflection portion and one or more flanges extending from the impact deflection portion, each of the one or more flanges including a notch causing at least a portion of the flange to be elevated above a support surface, a shock absorber disposed within the force transfer member and resting on the base, the shock absorber including a through hole, a plate disposed within the force transfer member and resting on the shock absorber, the plate including a through hole, and a fastener that extends through the base opening, the shock absorber through hole, and the plate through hole, the fastener including an end protruding from the base opening, the fastener end configured to secure the force transfer member to the support surface, and the force transfer member being configured so that when an impact force is applied to the force transfer member, the force is transferred from force transfer member to the shock absorber.

2. The impact absorption apparatus of claim 1 wherein a diameter of the opening of the base is greater than a diameter of the fastener.

3. The impact absorption apparatus of claim 1 wherein the impact deflection portion has a substantially semi-circular shape.

4. The impact absorption apparatus of claim 3 wherein the base has a substantially semi-circular shape.

5. The impact absorption apparatus of claim 3 wherein the shock absorber has a substantially semi-circular shape.

6. The impact absorption apparatus of claim 3 wherein the plate has a substantially semi-circular shape.

7. The impact absorption apparatus of claim 1 wherein the notch has a rectangular shape.

8. The impact absorption apparatus of claim 1 wherein the notch has a triangular shape.

9. The impact absorption apparatus of claim 1 wherein each of the one or more flanges has a substantially triangular shape.

10. The impact absorption apparatus of claim 1 wherein the impact absorption apparatus is configured to evenly distribute a force of impact from the force transfer member into the shock absorber.

11. The impact absorption apparatus of claim 1 wherein the shock absorber comprises an elastomeric material.

12. The impact absorption apparatus of claim 11 wherein the elastomeric material is a rubber material.

13. The impact absorption apparatus of claim 1 wherein the fastener comprises a bolt.

14. The impact absorption apparatus of claim 1 wherein the sidewall has an elongate tubular shape with a first cross-sectional diameter.

15. The impact absorption apparatus of claim 14 further comprising:

a cover having an elongate tubular shape with a second cross-sectional diameter greater than the first cross-sectional diameter, wherein the sidewall is disposed within the cover and the cover is able to rotate relative to the sidewall.

* * * * *